United States Patent [19]

Tanaka et al.

[11] 4,445,841

[45] May 1, 1984

[54] COMBUSTION CONTROL APPARATUS

[75] Inventors: Toshio Tanaka, Toride; Sumio Nakagawa, Matsudo; Kenzi Toudo, Yanai, all of Japan

[73] Assignee: Hitachi, Ltd., Tokyo, Japan

[21] Appl. No.: 305,714

[22] Filed: Sep. 25, 1981

[30] Foreign Application Priority Data

Aug. 24, 1981 [JP] Japan ..... 56-131518

[51] Int. Cl.[3] ..... F23N 5/00

[52] U.S. Cl. ..... 431/27; 431/31; 431/69

[58] Field of Search ..... 431/27, 29, 30, 31, 431/69, 70; 432/41

[56] References Cited

U.S. PATENT DOCUMENTS 3,489,500 1/1970 Giuffrida et al. ..... 431/69
4,192,641 3/1980 Nakagawa et al. ..... 431/31

FOREIGN PATENT DOCUMENTS 52-51120 4/1977 Japan ..... 431/31
54-153338 12/1979 Japan ..... 431/31

*Primary Examiner*—Lee E. Barrett
*Attorney, Agent, or Firm*—Antonelli, Terry & Wands

[57] ABSTRACT

A combustion control apparatus in which a predetermined number of pre-purge and igniting cycles are repeated until ignition takes place successfully. A pre-purge time interval of the second and subsequent igniting cycles is selected shorter than that of the first igniting cycle. When an existing combustion control element which is capable of performing the igniting cycle only once is employed, the intended combustion control is performed by appropriately controlling a reset terminal of the existing combustion control element of signals representative of expirations of the pre-purge time interval and the ignition time interval. The number of the igniting cycles is counted by a counter for stopping operation of the combustion apparatus when a predetermined count value is attained. A novel circuit for the combustion control element is also disclosed.

7 Claims, 6 Drawing Figures

COMBUSTION CONTROL APPARATUS

BACKGROUND OF THE INVENTION

The present invention relates in general to a combustion control apparatus to be employed for a combustion apparatus such as a hot water heating apparatus, a hot air heating apparatus and others, and in particular relates to a combustion control apparatus for controlling igniting operation of the combustion apparatus.

Generally, the combustion control apparatus of the kind described above is so designed as to drive at first a blower of a combustion apparatus in preparation for the igniting process for effecting a pre-purge operation for a predetermined time interval to discharge non-combustion gas from a combustion chamber and then perform the igniting operation by driving an ignitor system and opening a fuel valve. When ignition takes place within a predetermined ignition time interval, the operation of the ignitor is inhibited, whereby transition is made from the ignition phase to a steady combustion phase or state.

When ignition does not take place with the ignition time interval (i.e. in the case of failed ignition), it is usually determined that some trouble or failure occurs in the apparatus, whereby the operation of the whole apparatus is shut down.

However, in the combustion apparatus of some types which are not likely to be readily ignited, it is desirable to perform repeatedly the process of pre-purging and the igniting operation several times before the operation of the whole combustion apparatus is shut down due to the failure of ignition.

The pre-purge time interval is defined as a time duration required for discharging non-combustion gas filling the combustion chamber by supplying fresh air thereto by means of the blower. More specifically, in the case of a combustion apparatus in which a gaseous fuel is used, there may occur a situation where the combustion chamber is full of the gaseous fuel due to failure of a fuel value. In such case, the gaseous fuel has to be previously discharged completely. The time duration required for such discharging process is defined as the pre-purge time interval. It is obvious that the pre-purge time interval becomes longer as the capacity of the combustion apparatus increases.

Now, it is assumed that the igniting process inclusive of the pre-purge operation is repeated several times upon initiation of combustion. Then, the blower is continuously operated for a time which is equal to a product obtained by multiplying a sum of the pre-purge time interval and the ignition time interval with the number of repeated pre-purge and igniting operations or cycles. This means in the case of a hot water boiler, for example, that temperature of pooled hot water is lowered, involving non-uniform lowering of temperature of pooled hot water and a reduced system efficiency to great disadvantages. Further, in the case of a hot air heater apparatus, a lot of time is taken for generating hot air, which is obviously not only discomforatable to the user, but also disadvantageous from the economical view point.

There are known combustion control apparatus of the type in which the repetition of the pre-purge and ignition process is controlled by means of a motor and cam mechanism and another type of the in which the combustion control is performed by using a microcomputer. Both of these combustion apparatus are very expensive.

There has been proposed a combustion control circuit implemented in a form of an integrated circuit and capable of performing various functions required for controlling the combustion process. However, the known combustion control apparatus is so designed as to shut down operation of the associated combustion apparatus, when ignition has failed after a single pre-purge and ignition cycle. Accordingly, it is impossible to lengthen only the pre-purge time interval and at the same time to allow a number of the pre-purge and igniting operations to be repeatedly effected with the known combustion control integrated circuit. The same applies to the above-mentioned combustion control device in which the microcomputer is used.

SUMMARY OF THE INVENTION

An object of the present invention is to provide a novel and improved combustion control apparatus which is capable of repeating the pre-purge and ignition cycle for a predetermined number of times in a manner desirable with efficiency and economy.

Another object of the present invention is to provide the combustion control apparatus of the type mentioned above which can be implemented by using an existing (or commercially available) combustion control device.

According to a general feature of the invention, it is proposed that, when a first pre-purge and igniting operation has failed to produce ignition, the pre-purge time interval for the second and subsequent igniting operations, which is repeated for a predetermined number of times until ignition occurs, is made shorter than that of the first pre-purge and igniting process.

DESCRIPTION OF THE PREFERRED EMBODIMENTS

Figure 1:
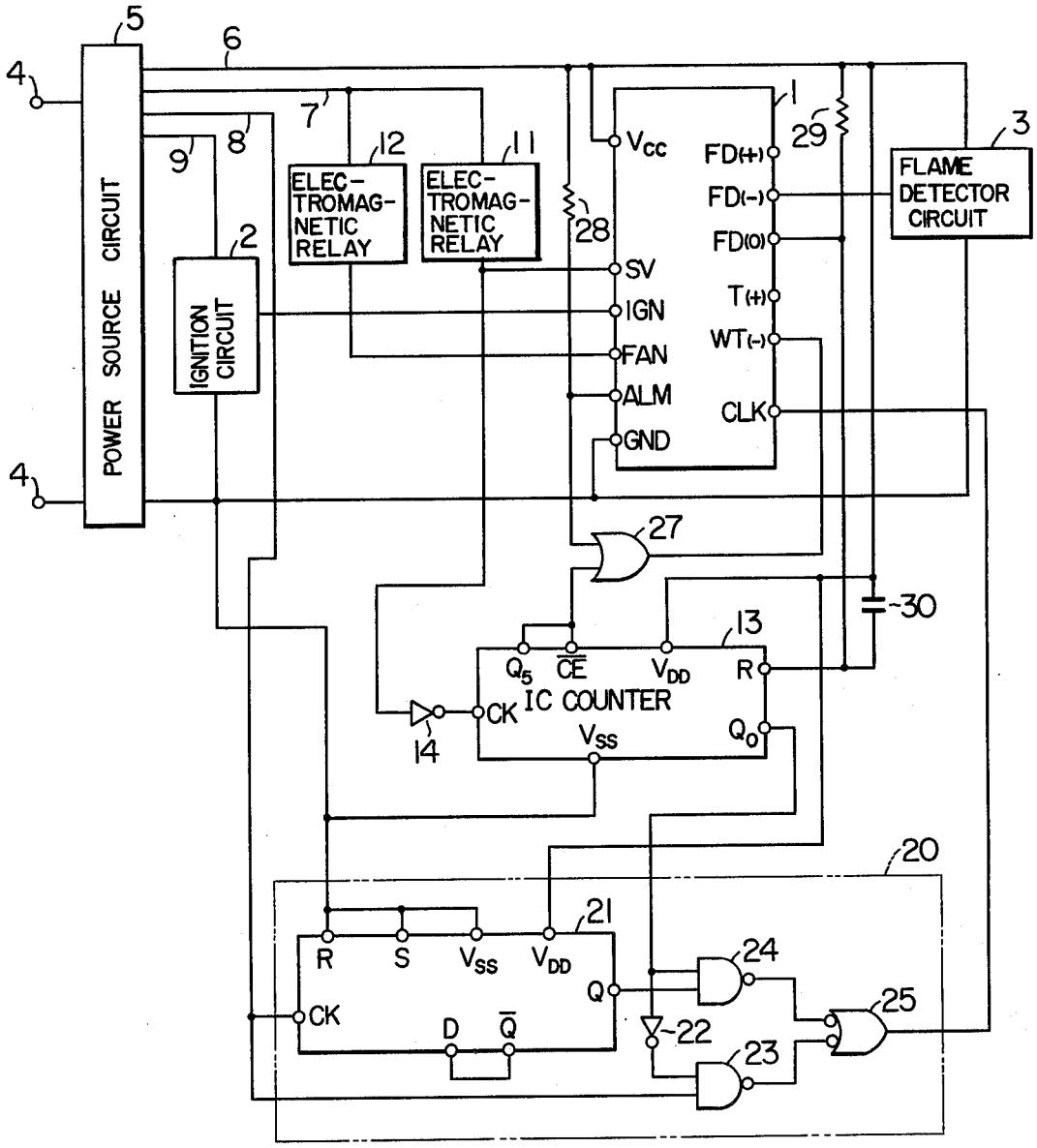
FIG. 1 is a schematic circuit diagram showing a general arrangement of a combustion control apparatus according to an exemplary embodiment of the invention.

Now, a combustion control apparatus according to an exemplary embodiment of the present invention will be described by referring to FIGS. 1 and 2. Reference numeral 1 denotes an integrated circuit imparted with capabilities for performing various functions required for controlling a process of combustion. In the case of the illustrated embodiment, the integrated circuit is constituted, by way of example only, by the one commercially available as "HA-16605 W" type integrated circuit from Hitachi Ltd. of Japan. This integrated circuit incorporates therein a timer for setting or measuring i.e. clocking a pre-purge time interval and an ignition time interval, a control circuit for controlling a blower, a fuel valve, an ignitor and others, and a security or safety control circuit for stopping operation of the combustion apparatus in response to alarm conditions such as non-ignited condition and the like. Describing more specifically the operation of the integrated circuit 1 in conjunction with the input-output terminals that are relevant to the operations of the combustion control apparatus according to the invention, a terminal labelled as VCC is an input terminal for a power supply source, and a terminal labelled as GND is a ground terminal. A terminal SV is used for commanding the opening of a fuel valve. A potential of logic "L" level appears at this terminal SV after expiration of a pre-purge time interval. A terminal labelled as IGN serves to command the operation of an ignition circuit 2. A potential of "L" level appears at this terminal IGN during an ignition time interval which follows the pre-purge time interval for driving the ignition circuit 2. A terminal FAN serves for commanding operation of the blower and is set to the "L" level when combustion is in progress. A terminal labelled as ALM is set to the "L" level in the event of occurrence of non-ignited or the like alarm condition at the end of the ignition time interval, to thereby produce an output signal representative of the alarm condition. At this time, both the terminals SV and FAN are set to high or "H" level to stop the combustion process. The terminal labelled as FD(+) and FD(−), respectively, are input terminals of a flame detecting comparator (not shown) incorporated in the integrated circuit, wherein the terminal FD(−) is connected to an output terminal of a flame detector circuit 3 which is adapted to produce in response to the presence of flame a signal voltage which is lower than the potential appearing at the terminal FD(+). Terminals labelled as T(+) and WT(−) are positive (plus) and negative (minus) input terminal of a temperature detecting comparator (not shown) incorporated in the integrated circuit. When the input voltages are such that T(+)>WT(−), the combustion process is shut down. In the case of the exemplary embodiment now being described, the terminals T(+) and WT(−) are not connected to a temperature detector circuit, but arrangement is made such that upon lowering of the temperature of a load, power-up from a power supply source 4 is turned on. A voltage setting circuit for the terminals FD(+) and T(+) is omitted from illustration. Terminal labelled as CLK is an input terminal for clock pulses which are counted by the integrated circuit to measure or clock the pre-purge time interval and the ignition time interval.

Further, in the alarm or the like condition in which the "L" level appears at the terminal ALM of the integrated circuit (HA-16605W) 1, when the input voltages to the terminals T(+) and WT(−) are set by some means so as to meet the condition that T(+)>WT(−), then the condition such as the alarm condition or the like is reset. Then the initial state is restored, i.e. operation is initiated again starting from the pre-purge phase.

A reference numeral 5 denotes a power source circuit which serves to rectify A.C. power into filtered D.C. power and produces a D.C. voltage of 5 V (volts) at a terminal 6 and D.C. voltage of 12 V at a terminal 7. The power source circuit 5 is further provided with a terminal 8 for producing the clock pulse signal for the timing or clocking operation. Numeral 11 denotes an electromagnetic relay for the fuel valve, and 12 denotes an electromagnetic relay for a combustion air blower.

A reference numeral 13 denotes an integrated circuit or IC counter (which may be constituted by HD-14022 B available from Hitachi Ltd.) for counting the number of the failed ignitions (i.e. the number of failed attempt of ignition) and has a clock input terminal CK which is connected to the D.C. terminal of 8 V of the power source circuit 5 through an inverter 14. In the illustrative embodiment, it is assumed that the igniting operation is permitted up to five times. To this end, an output terminal $Q_5$ producing a signal indicative of the fifth igniting operation is connected to a clock enable terminal $\overline{CE}$ of the counter 13 and additionally connected to the input terminal WT(−) described above by way of an OR gate 27.

Reference numeral 20 denotes a clock pulse rate change-over circuit which is composed of a frequency divider integrated circuit (IC)21 (e.g. HD-14013BP available from Hitachi Ltd.) for doubling the period of the clock pulse signal produced from the terminal 8 and a gate circuit. The pulse rate changeover circuit 20 serves to output a clock pulse signal having a period twice as long as that of the clock pulse signal appearing at the terminal 8 during the first pre-purge phase, and pass the clock pulse signal from the terminal 8 as it is during the succeeding pre-purge phases.

In operation, when the temperature of a load is lowered to cause the temperature detecting circuit to be operated, the power supply is turned on, whereby the power supply circuit 5 produces D.C. voltages from the terminals 6 and 7, an A.C. voltage from the terminal 9 and the clock pulse signal from the terminal 8. The integrated circuit 1 then starts operation. More specifically, the terminal FAN takes the "L" level potential to turn on the electromagnetic relay 12 for the blower, whereupon the pre-purging operation is started. Further, counting of the clock pulses applied to the terminal CLK is initiated for measuring duration of the pre-purging time interval.

Additionally, when the power supply 4 is turned on, a reset terminal R of the IC counter 13 is applied with a reset signal through a capacitor 30, whereby the counter 13 is initialized without fail.

During the first pre-purging operation, the terminal $Q_0$ of the IC counter 13 is at "H" level, resulting in that the output from the inverter 22 is at "L" level and that the output from a NAND gate 23 is at "H" level. The IC frequency divider 21 converts the clock pulse input to the terminal CK into a clock pulse signal having a doubled period which is outputted from the terminal Q and fed to the terminal CLK of the integrated circuit 1 through NAND gates 24 and 25.

When it is determined from the counting of the clock pulses inputted to the terminal CLK that the pre-purge time interval has elapsed, then it is the time to trigger the igniting operation. Thus, the terminal SV becomes at "L" level to turn on the electromagnetic relay 11 for allowing the fuel supply to be started. Further, the terminal IGN also takes "L" level, to thereby start operation of the ignition circuit 2.

When the terminal SV becomes at "L" level, the output from the inverter 14 is at "H" level, whereby the IC counter 13 can store the count value of the pre-purging operations as performed. More specifically, upon completion of the first pre-purging operation, the potential at the terminal $Q_0$ takes the "L" level, resulting in that the output from the NAND gate 24 is at "H" level and that the output from the inverter 22 is at "H" level. As the consequence, the clock pulse signal appearing at the terminal 8 of the source circuit 5 is applied to the terminal CLK of the integrated circuit 1 by way of the NAND gates 23 and 25.

When fuel is ignited as the result of the igniting operation described above, combustion of fuel is detected by the flame detecting circuit 3, whereby the ignition signal thus derived is applied to the terminal FD(−) of the integrated circuit 1. As the consequence, the potential at the terminal SV is maintained at "L" level, while the potential at the terminal ALM is continuously held at "H" level. The terminal IGN is at the potential of "H" level upon completion of the igniting operation, to thereby stop operation of the igniting circuit. Thus, a steady combustion phase is entered. When ignition is successfully completed, the potential at the terminal FD(0) of the integrated circuit 1 becomes high or "H", whereby the IC counter 13 is initialized. Numeral 29 denotes a resistor.

Unless combustion takes place during the igniting phase, the terminals SV, FAN and IGN of the integrated circuit 1 take the potential of "H" level upon expiration of the ignition time interval, to cause the overall operation to be stopped. At the same time, the terminal ALM assumes the potential of "L" level to indicate the alarm condition.

However, at that time in the first to the fourth pre-purging operations, the terminal $Q_5$ of the IC counter 13 is at "L" level. Consequently, the output from the OR gate 27 is at "L" level due to the "L" level prevailing at the terminal ALM as brought about by the failed ignition, resulting in that T(+)>WT(−). Thus, the alarm condition is cleared by the integrated circuit 1. Then, the terminal ALM assumes "H" level, giving rise to the "H" level of the output from the OR gate 27 by way of the resistor 28, whereby the condition that T(+)<WT(−) is reestablished. This means that the load is at a low temperature. The control operation of the integrated circuit 1 is thus initiated again starting from the pre-purging operation. In other words, the terminal FAN is set again to the "L" level.

In the second and succeeding cycles, similar operations take place. Upon failed ignition in each of these cycles, the control operation described is repeated starting from the pre-purging phase. In this connection, it should however be noted that, since the clock pulses appearing at the terminal 8 of the source circuit 5 are directly applied to the terminal CLK of the integrated circuit without undergoing the frequency division in the second and succeeding cycles, the pre-purge time interval is decreased to a half of the pre-purge time required in the first cycle.

Upon completion of the fifth pre-purge, the potential at the terminal $Q_5$ of the IC counter 13 becomes high or "H" level to indicate that this is the fifth igniting operation. The potential of "H" level at the terminal $Q_5$ is applied to the terminal $\overline{CE}$ and held. As the consequence, even when the terminal ALM assumes the potential of "L" level due to failure in ignition in the fifth igniting cycle, the output from the OR gate 27 is held at the "H" level. Then, the alarm condition is not removed by the integrated circuit 1 but remains unchanged.

Figure 2:
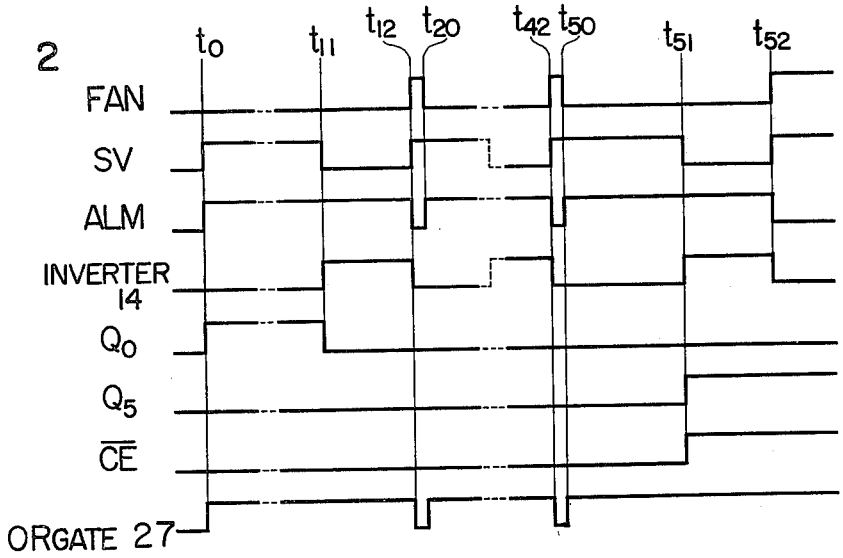
FIG. 2 is a signal waveform diagram illustrating waveforms of signals produced at different circuit points of the circuit illustrated in FIG. 1 when igniting operation has failed.

Waveforms of signals produced at various circuit points of the circuit shown in FIG. 1 for the failed ignition are illustrated in FIG. 2. At time points $t_0$, $t_{20}$ and $t_{50}$, the pre-purging operations for the first, second and the fifth igniting operation are initiated, while at $t_{11}$ and $t_{51}$, the pre-purgings for the first and the fifth igniting operations are terminated, respectively. At time points $t_{12}$, $t_{42}$ and $t_{52}$, the first, fourth and the fifth igniting operations are completed.

Next, a circuit arrangement of the integrated circuit 1 which is capable of being reset in response to the condition that T(+)>WT(−) will be described by referring to FIG. 3. It should be mentioned here that the circuit configuration shown in FIG. 3 is not necessarily identical with that of the integrated circuit HA-16605W of Hitachi Ltd.

Figure 3:
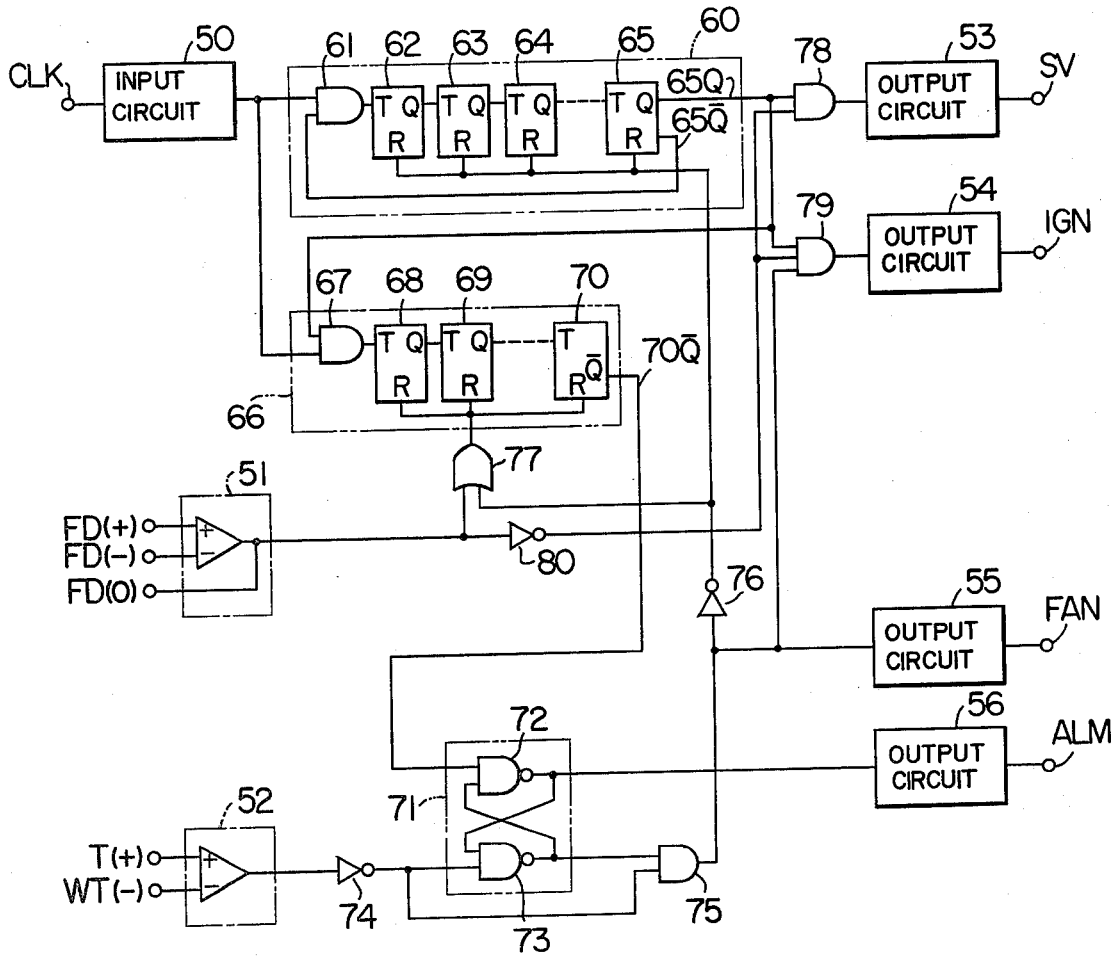
FIG. 3 is a circuit diagram illustrating a circuit configuration of a combustion control integrated circuit.

In FIG. 3, reference numerals 50, 51 and 52 denote input circuits for associated signals, while reference numerals 53, 54, 55 and 56 denote output circuits for associated signals. The input circuits 51 and 52 include comparators, respectively.

Reference numeral 60 denotes a pre-purge timer for setting or measuring the pre-purge time interval, which timer is composed of an AND gate 61 and a plurality of flip-flops 62, 63, 64 and 65 for frequency division. Reference numeral 66 denotes an ignition timer for clocking or measuring the ignition time interval, which timer is composed of an AND gate 67 and a plurality of flip-flops 68, 69 and 70 for frequency division. Each of the flip-flops 62 to 65 and 68 to 69 for frequency division is reset in response to "H" level at the respective reset input terminal R, whereby potential of "L" level appears at an output terminal Q, while "H" level makes appearance at an output terminal $\overline{Q}$. When the reset input terminal R is at "L" level, the frequency dividing operation is allowed to take place.

Reference numeral 71 denotes a RS-flip-flop composed of NAND gates 72 and 73. In the initialized state, the output of the NAND gate 72 is at the low or "L" level, resulting in the "H" level at the terminal ALM.

With the circuit arrangement shown in FIG. 3 and described above, it is assumed that the terminal WT(−) is at "H" level, indicating the low temperature state of a load. When the power is turned on, the output from the input circuit 52 is at "L" level, the output from the inverter 74 is at "H" level and the output from the NAND gate 75 is at "H" level, whereby the terminal FAN is set to "L" level, to cause the pre-purging operation to be initiated. On the other hand, since the output from the inverter 76 is at "L" level, the flip-flops 62 to 65 and 68 to 70 for frequency division are released from the reset state. Thus, the pre-purge timer 60 begins to clock. When the pre-purge time has elapsed, the output terminal 65Q becomes high or at "H" level, causing the outputs from the AND gates 78 and 79 to be high or at "H" level, respectively, as the result of which the terminals SV and IGN are set to the low or "L" level, to thereby allow the igniting operation to be initiated. Since the output terminal 65$\overline{Q}$ is then at "L" level, the pre-purge timer 60 stops the frequency dividing operation. On the other hand, the ignition timer initiates the clocking operation in response to the "H" level appearing at the output terminal 65Q.

Upon successful ignition, the potential at the terminal FD(0) and the output from the input circuit 51 become high or at "H" level, whereby the output from the OR gate 77 becomes high to cause the ignition timer 66 to be reset. Further, since the output from the inverter 80 becomes at "L" level while the potential at the terminal IGN is at "H" level, the igniting operation is stopped. The ignition phase thus goes into the steady combustion phase.

In the case of the failed ignition, the output terminal $70\overline{Q}$ of the ignition timer becomes low (i.e. at "L" level), as the result of which the RS-flip-flops 71 is set, causing the output from the NAND gate 72 to be at "H" level, while the potential at the terminal ALM is set to "L" level. On the other hand, the output from the NAND gate 73 becomes low, resulting in the "L" level output from the AND gate 75. Thus, all the terminals SV, IGN and FAN are set to "H" level, to stop the operation.

According to the operating method, a temperature sensor output signal is applied to the terminal WT (−). As the temperature of a load is increased under heating by the steady combustion, the potential at the terminal WT(−) is decreased, causing the output from the input circuit 52 to be high ("H"), while the output from the AND gate 75 is caused to be low ("L"). On these conditions, the combustion operation is stopped and at the same time the pre-purge timer 60 is reset. The ignition timer 66 is in the state ready to be reset through the OR gate 77. Further, assuming that the RS-flip-flop 71 is set due to failed ignition and that the terminal ALM is at "L" level, indicating the alarm condition, application of "L" level potential to the terminal WT(−) as described above will cause the pre-purge timer 60 and the ignition timer 66 to be reset, thereby causing the output terminal $70\overline{Q}$ to be at "H" level, while the RS-flip-flop 71 is reset, to thereby remove the alarm condition. Accordingly, when the same "H" level potential as that representative of the low temperature condition is subsequently applied to the terminal WT(−), operation is performed from the beginning of the pre-purging phase. In this sense, it may be said that the terminal WT(−) is a reset terminal.

In this manner, when the terminal WT(−) becomes at "L" level upon completion of the first, second, third or fourth igniting operation, the integrated circuit 1 is reset, whereby the terminal ALM is caused to be at "H" level and released from the reset state, allowing the pre-purging operation to be started again.

By virtue of such feature that the time duration required for the second and succeeding pre-purge operations can be reduced as compared with the time duration required for the first pre-purge operation according to the invention, as is apparent from the foregoing description, operation of the combustion apparatus to which the combustion control according to the invention is applied is significantly improved from the view point of economy and comfortableness in use. Further, it is possible to perform the igniting operation a predetermined number of times by using an existing integrated circuit which is capable of performing the igniting operation only once. Additionally, the first one of the pre-purge time intervals of a predetermined duration (corresponding to a predetermined number of clock pulses) can be lengthened. Since the timing with which the rate of the clock pulse signal for clocking the pre-purge time interval is changed is set at the end of the first pre-purge time interval, the ignition time interval which succeeds the first ignition time interval can be made equal to the latter. Further, because of the control operation is based on the control of the reset terminal of the integrated circuit, the combustion control circuit can be implemented in a simplified configuration.

Figure 4:
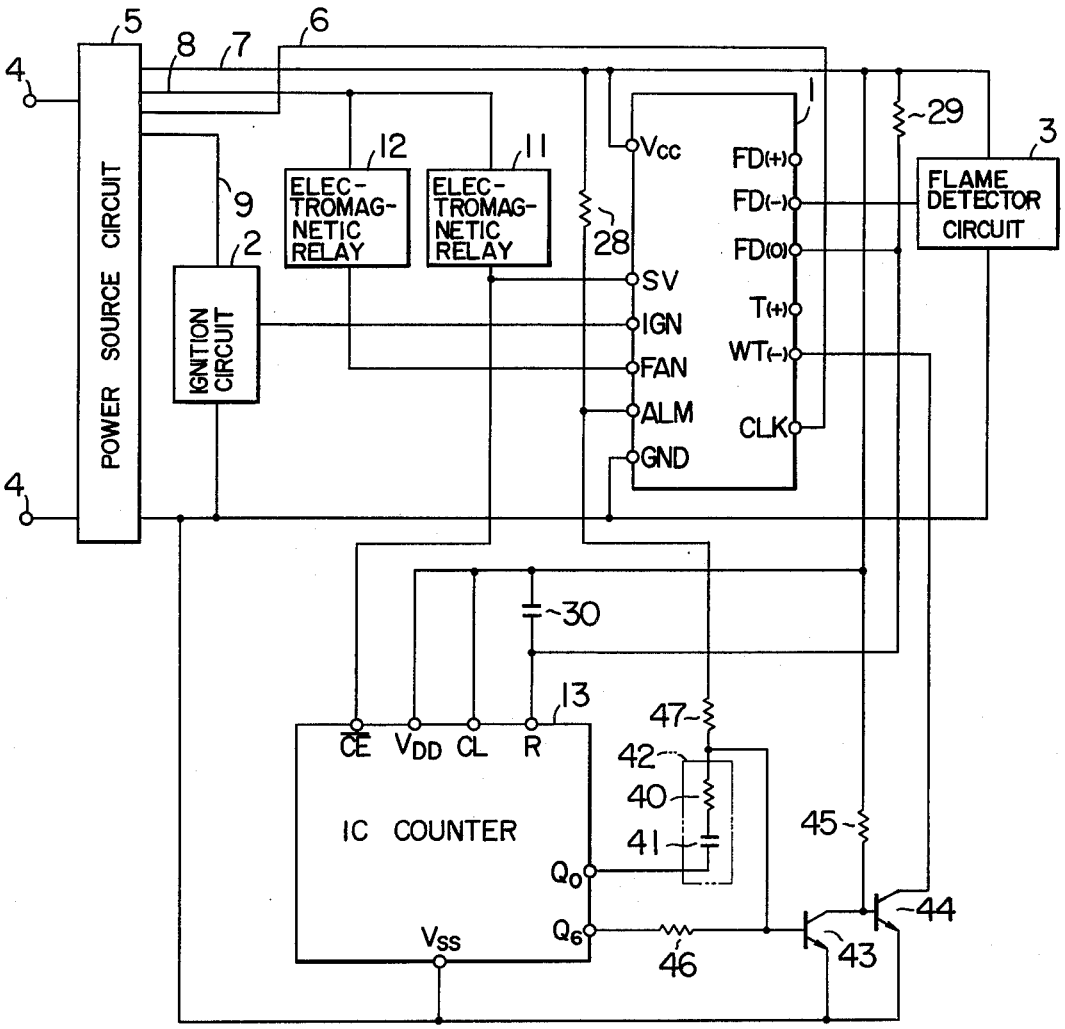
FIG. 4 is a circuit diagram illustrating a general arrangement of the combustion control apparatus according to another embodiment of the invention.

FIG. 4 shows another exemplary embodiment of the invention. The terminal $\overline{CE}$ of the IC counter 13 is connected to the terminal SV of the integrated circuit 1. A differentiating circuit 42 composed of a resistor 40 and a capacitor 41 is connected to the terminal $Q_0$ of the IC counter 13. The signal indicative of the fifth igniting operation is outputted from the terminal $Q_6$. Numerals 43 and 44 denote transistors, and 45, 46 and 47 denote resistors.

With the arrangement illustrated in FIG. 4 and described above, when the terminal SV goes at low or "L" level, the IC counter 13 determines completion of the first pre-purge phase and outputs "L" level at the terminal $Q_0$. As the consequence, the transistor 43 is rendered non-conductive or off with the transistor 44 being conductive during a time interval determined by the time constant of the differentiating circuit 42, resulting in that T(+)>WT(−). The pre-purge timer 60 is thus reset so as to allow the pre-purging operation to be repeated again. At every end of the second and the subsequent pre-purge phases, the terminal $Q_0$ is successively held at "L" level, the time duration of the second and the subsequent pre-purge phase is reduced to a half of the first pre-purge time interval. When the first to the fourth igniting operations have failed, the potential at the terminal ALM assumes "L" level, whereby the transistor 43 is rendered non-conductive or off while the transistor 44 is turned on, so that the pre-purging operation may be repeated again. When the fifth igniting operation fails, the potential at the terminal $Q_6$ is at high or "H" level, whereby the transistor 43 is held in the conducting state, while the transistor 44 remains in the non-conducting state.

It is assured according to the embodiment shown in FIG. 4 that a desired number of igniting operation can be repeatedly carried out with the time interval for the first pre-purge phase being lengthened relative to the succeeding or subsequent pre-purge phases with a much simplified circuit configuration.

Figure 5:
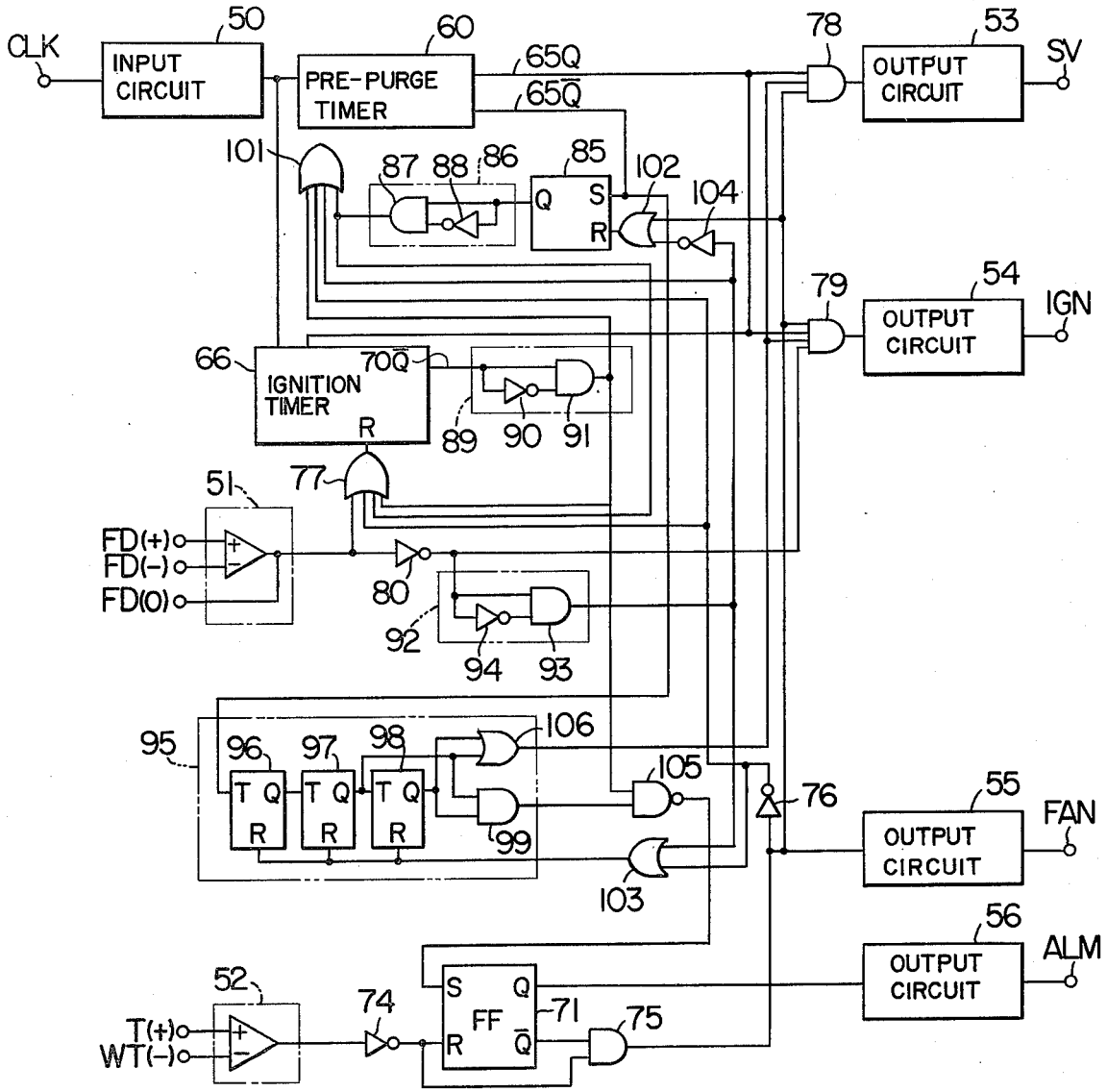
FIG. 5 illustrating a circuit diagram of a combustion control integrated circuit according to another embodiment of the present invention.

FIG. 5 is a circuit diagram of an integrated circuit in which all the functions of the control apparatus shown in FIG. 4 are implemented. In FIG. 5, reference numeral 85 denotes a RS-flip-flop, 86 denotes a differentiating circuit composed of an AND gate 87 and an odd number of inverters 88, numeral 89 denotes a differentiating circuit composed of an AND gate 91 and an odd number of inverters 90, numeral 92 denotes another differentiating circuit composed of an AND gate 93 and an odd number of inverters 94, and numeral 95 denotes a counter circuit for frequency division which is composed of flip-flops 96, 97 and 98 and an AND gate 99 whose output becomes at "H" upon completion of the (n+1)-th igniting operation where n represents a predetermined number. Reference numerals 101, 102 and 103 denote OR gates, 104 denotes an inverter, 105 denotes a NAND gate and 106 denotes an OR gate.

With such circuit arrangement, when a first half of the first pre-purge time interval elapsed, the output terminal $65\overline{Q}$ becomes low to set the RS-flip-flop 85 which output Q becomes high, to thereby cause the pre-purge timer 60 to be reset through the differentiating circuit 86 and the OR gate 101. Thus, the pre-purge timer 60 is in the state to perform again the clocking operation. At this time, the OR gate 106 functions to inhibit the outputs from the terminals SV and IGN. Upon completion of the first pre-purging operation, the ignition timer 66 starts the clocking operation. When the output terminal 70Q of the ignition timer 66 becomes at "H" level due to failed ignition, the pre-purge timer 60 and the ignition timer 66 are reset by way of the differentiating circuit 89 and the OR gates 101 and 77, to cause the second igniting operation to be initiated again. The number of clocking operations of the pre-purge timer 60 is counted by the counter circuit 95. When the fifth igniting operation has proved failed, the output from the NAND gate 105 becomes low, to thereby set the RS-flip-flop 71. The alarm condition thus occurs.

When flame disappears after the ignition, the pre-purge timer 60, the ignition timer 66, the counter circuit 98 and the RS-flip-flop 85 are reset in response to the output from the differentiating circuit 92.

Figure 6:
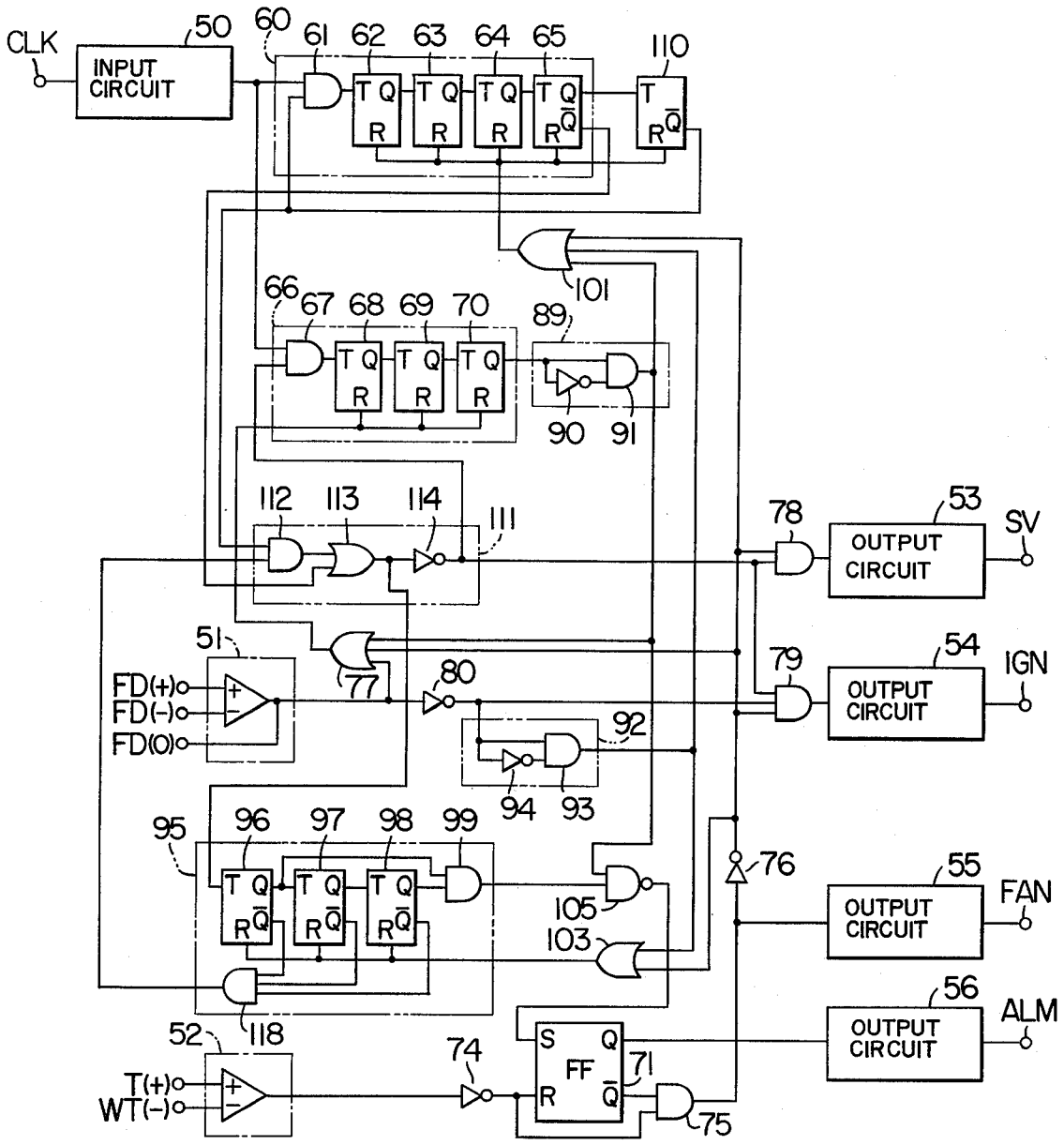
FIG. 6 is a circuit diagram illustrating a combustion control integrated circuit implemented according to a further exemplary embodiment of the present invention.

Next, description will be made on another exemplary embodiment shown in FIG. 6. Reference numeral 110 denotes a flip-flop circuit for frequency division which serves as a timer for producing an end signal of the pre-purge time interval in the first igniting operation cycle. Numeral 111 denotes a timer change-over circuit which is composed of an AND gate 112, an OR gate 113 and an inverter 114 and functions to allow the output from the pre-purge timer 60 to be inputted to the ignition timer 66 and the counter circuit 95 upon completion of the first igniting operation. During the time interval which precedes the completion of the first igniting operation, the output from the frequency divider flip-flop circuit 110 is inputted to the ignition timer 66 and the counter circuit 95. Numeral 118 denotes an AND gate adapted to produce a signal indicative of completion or end of the first igniting operation. The ignition time interval $T_1$ is generally so selected that the condition of $T_1 \leqq T_3 - T_2$ is fulfilled, where $T_2$ represents the first pre-purge time interval (outputted from the frequency divider flip-flop circuit 110) and $T_3$ represents the second and the succeeding or subsequent pre-purge time interval (outputted from the pre-purge timer 60).

With such arrangement, when the output $\overline{Q}$ of the time divider flip-flop circuit 110 assumes the "L" level in the first igniting operation, the output from the inverter 114 of the timer change-over circuit 111 assumes the "H" level, whereupon the ignition timer 66 starts the frequency dividing operation. Further, since the output from the OR gate 113 becomes low, the counter circuit 95 performs a counting operation, whereby the output of the AND gate 118 becomes low (at "L" level). As a consequence, the timer change-over circuit 111 then causes the output from the terminal 65$\overline{Q}$ of the pre-purge timer 60 to be subsequently supplied to the ignition timer 66 and the counter circuit 95. Further, the timer change-over circuit 111 causes the AND gates 78 and 79 to output the signal representative of completion of the pre-purge phase. Other operations are effected in a manner similar to those of the combustion control apparatus shown in FIG. 4.

As will be appreciated from the foregoing description, the pre-purge phase or time interval for the second and the succeeding or subsequent ignition operations, if required, is shortened as compared with the pre-purge time interval for the first igniting operation according to the teaching of the present invention. By virtue of this feature, improved economy and smoothness in operation can be assured even when the ignition processes are repeatedly performed.

We claim:

1. A combustion control apparatus, comprising:

a first input terminal for inputting a signal commanding initiation of operation, a second input terminal for inputting a signal representative of presence or absence of flame and a third input terminal to which a clock pulse signal is applied;

a timer circuit adapted to divide frequency of said clock pulse signal applied to said third input terminal for clocking a first time interval and a second time interval which follows said first time interval and produce signals representative of expirations of said first and second time intervals, respectively, the signal representative of expiration of said first time interval being held during said second time interval, wherein said first time interval made effective at a first time is selected longer than the first time interval made effective at second and subsequent times;

a differentiating circuit adapted to produce a differentiated signal for resetting said timer circuit in response to the signal representative of expiration of said second time interval;

a counter circuit adapted to count the number of expirations of said first time interval on the basis of the signal representative of expiration of said first or said second time interval to thereby produce a first signal upon a predetermined count of said number of expirations of said first time interval;

a first logic circuit having inputs supplied with said first signal and the output signal from said differentiating circuit or the signal representative of expiration of said second time interval;

a storage circuit adapted to produce a third signal for inhibiting operations of an ignitor and a fuel valve in response to said second signal, and further adapted to hold the inhibited state; and a second logic circuit adapted for resetting said timer circuit, said counter circuit and said storage circuit in response to said operation initiating signal applied to said first input terminal, producing a fourth signal from a fourth output terminal for driving a blower during said first time interval, producing fifth and sixth signals from fifth and sixth output terminals, in addition to said fourth signal, for energizing said ignitor and said fuel valve during said second time interval, and inhibiting output of the signal representative of expiration of said second time interval in response to the signal representing the presence of flame and applied to said second input terminal during said second time interval, while allowing said third signal to be inputted to said second logic circuit.

2. A combustion control apparatus as set forth in claim 1 wherein said timer circuit is composed of a first timer circuit and a second timer circuit, said first timer circuit including a first timer for outputting the signal representative of expiration of said first time interval, a third logic circuit for interrupting the supply of said clock pulse signal to said first timer in response to the signal representative of expiration of said first time interval, a second storage circuit adapted for storing expiration of a first half of said first time interval for a first igniting operation in response to the signal representative of expiration of said first time interval, and a second differentiating circuit for producing a differentiated signal for resetting said first timer in response to an output signal from said storage circuit which is produced in response to the signal representative of expiration of said first time interval;

said second timer being set to clock said second time interval in response to the signal representative of expiration of said first time interval; and said counter circuit being adapted to produce said first signal in response to the signal representative of the (n+1)-th expiration of said first time interval, where n represents said predetermined number of times.

3. A combustion control apparatus as set forth in claim 1, wherein said timer circuit comprises a third timer circuit, a fourth timer circuit, a fifth timer circuit and a timer change-over circuit;

said third timer circuit being adapted to produce the signal representative of expiration of said first time interval for the second and subsequent igniting operation;

said fourth timer circuit being adapted for receiving the output signal from said third timer circuit as the clock pulse signal input and producing the signal representative of expiration of said first time interval for the first igniting operation;

said timer change-over circuit having inputs supplied with output signals from said third timer circuit, said fourth timer circuit and said counter circuit and being adapted to output a seventh signal for allowing said fifth timer to clock said second time interval and an eighth signal enabling said counter circuit to perform the counting operation thereof in response to the signal representing expiration of said first time interval and produced from said fourth timer circuit for the first igniting operation or in response to the signal representing the expiration of said first time interval and produced from said third timer circuit for the second and subsequent igniting operations.

4. A combustion control apparatus, comprising:

a combustion controlling integrated circuit element including a first input terminal supplied with a flame detection signal representative of presence or absence of flame, a second input terminal supplied with a reset signal, a third input terminal supplied with a clock pulses, timer means for clocking a first time interval and a second time interval by counting said clock pulses applied to said third input terminal, and control means for responding the input signals from said first input terminal, said second input terminal and said timer means to drive a blower during said first time interval for preparation of ignition, energize said blower, an ignitor and a fuel valve during said second time interval following said first time interval, and produce continuously the output signal for energizing said fuel valve in response to the falme detection signal supplied to said first input terminal, while said control means is adapted to be reset together with said timer means in response to said reset signal applied to said second input terminal, said integrated circuit element further including a first output terminal, a second output terminal and a third output terminal connected to energize said blower, said ignitor and said fuel valve, respectively;

a counter circuit adapted to count the number of expirations of said first time interval in response to the input signal supplied from said second or said third output terminal, and having a fourth output terminal for producing a signal representative of the single expiration of said first time interval and a fifth output terminal for producing a signal representative of a predetermined number of expirations of said first time interval; and a reset signal output circuit having inputs supplied with the signals produced from said fourth output terminal and said fifth output terminal to thereby produce the signal supplied to said second input terminal, wherein so far as said fifth output terminal produces a signal representative of a number of expirations of said first time interval which number is smaller than said predetermined number, said reset signal output circuit responds to the signal produced from said fourth output terminal and representing the single expiration of said first time interval to thereby reset said combustion control integrated circuit element and then release said integrated circuit element from the reset state.

5. A combustion control apparatus set forth in claim 4, wherein said reset signal output circuit comprises a differentiating circuit connected to said fourth output terminal, and an OR circuit having inputs supplied with the output signal from said differentiating circuit and the output signal from said fifth output terminal, respectively, and adapted to produce the reset signal applied to said second input terminal.

6. A combustion control apparatus set forth in claim 5, wherein said reset signal output circuit comprises an AND circuit having inputs supplied with the signals from said fourth output terminal and said fifth output terminal, respectively, and a differentiating circuit coupled to the output of said AND circuit for producing an output signal applied to said second input terminal.

7. A combustion control apparatus, comprising:

a combustion control integrated circuit element including a first input terminal supplied with a flame detection signal representative of presence or absence of flame, a second input terminal supplied with a clock pulse signal, timer means for counting the clock pulses applied to said second input terminal to thereby clock a first time interval and a second time interval, and control means having inputs supplied with the signals from said first input terminal, said second input terminal and said timer means for energizing a blower during said first time interval for igniting operation, energizing said blower, an ignitor and a fuel valve for said second time interval following said first time interval, and producing continuously an output signal for energizing said fuel valve in response to said flame detection signal applied to said first input terminal, said combustion control integrated circuit further including a first output terminal, a second output terminal and a third output terminal for energizing said blower, said ignitor and said fuel valve, respectively;

a frequency divider circuit for dividing the first clock pulse signal to thereby produce a second clock pulse signal; and a clock pulse signal change-over circuit having inputs supplied with the signal from said second output terminal or alternatively from said third output terminal, said first clock pulse signal and said second clock pulse signal to thereby produce said first clock pulse signal or alternatively said second clock pulse signal at said third input terminal, wherein said second clock pulse signal output is changed over to said first clock pulse signal output in response to a signal representing expiration of said first time interval and appearing at said second output terminal or alternatively at said third output terminal.

* * * * *